US010029814B2

(12) United States Patent
Galata'

(10) Patent No.: US 10,029,814 B2
(45) Date of Patent: Jul. 24, 2018

(54) FOLDING UNIT FOR PRODUCING FOLDED PACKAGES OF POURABLE FOOD PRODUCTS FROM RELATIVE SEALED PACKS

(75) Inventor: Alessandro Galata', Lund (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 807 days.

(21) Appl. No.: 14/127,586

(22) PCT Filed: Sep. 5, 2012

(86) PCT No.: PCT/EP2012/067244
§ 371 (c)(1),
(2), (4) Date: Jan. 24, 2014

(87) PCT Pub. No.: WO2013/064290
PCT Pub. Date: May 10, 2013

(65) Prior Publication Data

US 2014/0196417 A1 Jul. 17, 2014

(30) Foreign Application Priority Data

Oct. 31, 2011 (EP) ..... 11187351

(51) Int. Cl.
*B65B 61/24* (2006.01)
*B65B 7/20* (2006.01)
*B65B 9/10* (2006.01)

(52) U.S. Cl.
CPC ..... *B65B 61/24* (2013.01); *B65B 7/20* (2013.01); *B65B 9/10* (2013.01)

(58) Field of Classification Search
CPC ..... B65B 61/24; B65B 7/20; B65B 9/10
See application file for complete search history.

(56) References Cited

U.S. PATENT DOCUMENTS 4,510,732 A 4/1985 Löthman
5,261,520 A 11/1993 Duke
(Continued)

FOREIGN PATENT DOCUMENTS

CN 1441744 A 9/2003
CN 1721276 A 1/2006
(Continued)

OTHER PUBLICATIONS

International Search Report (PCT/ISA/210) dated Dec. 11, 2012, by the European Patent Office as the International Searching Authority for International Application No. PCT/EP2012/067244.
(Continued)

*Primary Examiner* — Hemant M Desai
*Assistant Examiner* — Mobeed Ahmed
(74) *Attorney, Agent, or Firm* — Buchanan Ingersoll & Rooney PC

(57) ABSTRACT

There is described a folding unit for producing folded packages of pourable food products from relative sealed packs. The folding unit comprises conveying means fed with a plurality of packs at an input station and advancing the packs along a forming path to an output station, and folding means cooperating, in use, with each pack to perform at least one folding operation on the pack; the conveying means comprise an endless transport element formed by a plurality of mutually hinged rigid modules and looped about at least one driving sprocket and at least one idler element; the idler element comprises cam means cooperating with respective cam followers of the modules and so shaped to compensate the periodical variation of the radius of the modules on the driving sprocket due to their rigidity.

9 Claims, 17 Drawing Sheets

(56) References Cited

U.S. PATENT DOCUMENTS 5,836,139 A * 11/1998 Yoshida ..... B65B 7/16 53/387.3
5,966,899 A * 10/1999 Fontanazzi ..... B65B 7/20 53/374.7
6,035,615 A * 3/2000 Hansson ..... B29C 65/18 493/302
6,038,838 A * 3/2000 Fontanazzi ..... B65B 51/30 53/551
6,385,950 B1 * 5/2002 Anderson ..... B65B 49/12 493/164
7,793,484 B2 * 9/2010 Santi ..... B65B 7/18 53/374.7
9,120,584 B2 * 9/2015 Santi ..... B65B 7/18
2003/0146271 A1 8/2003 Furini et al.
2009/0005227 A1 * 1/2009 Rimondi ..... B65B 49/08 493/184
2009/0090088 A1 * 4/2009 Nemkov ..... B29C 65/08 53/477
2009/0113848 A1 * 5/2009 Santi ..... B65B 7/18 53/374.7
2009/0193763 A1 * 8/2009 Fontanazzi ..... B65B 49/08 53/456
2011/0120059 A1 * 5/2011 Andreotti ..... B29C 65/18 53/451
2013/0133281 A1 * 5/2013 Cappelle ..... B27B 5/06 52/588.1
2013/0227918 A1 * 9/2013 Paradisi ..... B65B 9/12 53/551
2013/0237396 A1 * 9/2013 Paradisi ..... B65B 61/24 493/243
2013/0263556 A1 * 10/2013 Babini ..... B29C 65/3656 53/370.7
2014/0194267 A1 * 7/2014 Pradelli ..... B65B 49/04 493/243
2014/0196417 A1 * 7/2014 Galata' ..... B65B 61/24 53/551
2014/0223858 A1 * 8/2014 Pedretti ..... B65B 35/58 53/203
2014/0228193 A1 * 8/2014 Pradelli ..... B65B 49/02 493/180
2014/0371046 A1 * 12/2014 Catellani ..... B31B 3/02 493/162

FOREIGN PATENT DOCUMENTS

| | | | |
|---|---|---|---|
| CN | 101180218 | A | 5/2008 |
| CN | 201105816 | Y | 8/2008 |
| CN | 101395063 | A | 3/2009 |
| EP | 0 887 264 | A1 | 12/1998 |
| EP | 1059236 | A | 12/2000 |
| EP | 0 887 261 | B1 | 9/2005 |
| EP | 1 616 796 | A1 | 1/2006 |
| EP | 2 123 563 | A1 | 11/2009 |
| JP | 1170905 | | 3/1999 |
| JP | 2008540280 | A | 11/2008 |
| JP | 2010168071 | A | 8/2010 |

OTHER PUBLICATIONS

U.S. Appl. No. 14/127,505, filed Feb. 11, 2014, Pedretti et al.
U.S. Appl. No. 14/127,613, filed Jan. 24, 2014, Pedretti et al.
U.S. Appl. No. 14/127,503, filed Feb. 11, 2014, Pradelli.
U.S. Appl. No. 14/127,506, filed Jan. 22, 2014, Pedretti et al.
U.S. Appl. No. 14/127,520, filed Jan. 22, 2014, Pedretti et al.
Office Action dated Aug. 8, 2014, by the State Intellectual Property Office of People's Republic China in corresponding Chinese Patent Application No. 201280032842.4, and an English Translation of the Office Action. (17 pages).
Office Action (Notice of Reasons for Rejection) dated Aug. 8, 2016, by the Japanese Patent Office in corresponding Japanese Patent Application No. 2014-537532 and an English translation of the Office Action. (6 pgs).
Office Action (Decision of Granting) dated May 30 2016, by the Russian Patent Office in corresponding Russian Patent Application No. 2014121892/13(035465), and an English Translation of the Office Action. (11 pages).

* cited by examiner

FOLDING UNIT FOR PRODUCING FOLDED PACKAGES OF POURABLE FOOD PRODUCTS FROM RELATIVE SEALED PACKS

TECHNICAL FIELD

The present invention relates to a folding unit for producing folded packages of pourable food products from relative sealed packs.

BACKGROUND ART

As is known, many food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may comprise a layer of fibrous material, e.g. paper, or of mineral-filled polypropylene material; and a number of layers of heat-seal plastic material, e.g. polyethylene film, covering both sides of the base layer.

In the case of aseptic packages for long-storage products, such as UHT milk, the packaging material may also comprise a layer of gas- and light-barrier material, e.g. an aluminium foil or an ethyl vinyl alcohol (EVOH) foil, which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material. The web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating. The web of packaging material so sterilized is maintained in a closed, sterile environment, and is folded and sealed longitudinally to form a vertical tube.

The tube is filled continuously downwards with the sterilized or sterile-processed food product, and is sealed and then cut along equally spaced cross sections to form pillow packs, which may be fed to a folding unit to form the finished packages.

More specifically, the pillow packs substantially comprise a main portion, and opposite top and bottom end portions tapering from the main portions towards respective top and bottom sealing bands which extend substantially orthogonal to the axis of the pack. In detail, each end portion is defined by a pair of respective trapezoidal walls which extend between main portion of the pack and the relative sealing band.

Each pillow pack also comprises, for each top and bottom end portion, an elongated substantially rectangular fin projecting from respective sealing bands; and a pair of substantially triangular flaps projecting from opposite sides of relative end portion and defined by respective trapezoidal walls.

The end portions are pressed towards each other by the folding unit to form flat opposite end walls of the pack, while at the same time folding the flaps of the top portion onto respective lateral walls of the main portion and the flaps of the bottom portion onto the bottom sealing band.

Packaging machines for producing packages of the above type are known, substantially comprising:

- an in-feed conveyor;
- a folding unit receiving the pillow packs from the in-feed conveyor and adapted to fold these pillow packs to form relative parallelepiped-shaped packages; and
- an out-feed conveyor which receives folded packages from the folding unit and moves them away from the packaging machine.

Folding units are known, for example from EP-B-0887261 in the name of the same Applicant, which typically comprise:

- an endless conveyor for feeding packs continuously along a forming path from a supply station to an output station;
- a number of folding devices arranged in fixed positions relative to the forming path and cooperating with packs to perform relative folding operations thereon;
- a heat-sealing device acting on respective triangular flaps of each pack to be folded, to melt the external layer of the packaging material and seal the flaps onto respective walls of the pack; and
- a pressing device cooperating with each pack to hold the triangular portions on respective walls as these portions cool.

In detail, the conveyor comprises an endless chain looped about and meshing with a driving sprocket and an idler wheel and formed by a plurality of links mutually connected by hinge pins at respective hinge points; the conveyor also comprises a tightener acting on the chain to maintain it at a constant tension.

The chain comprises a top straight branch, a bottom straight branch and two curved portions which are opposite to each other, respectively cooperate with the driving sprocket and the idler wheel and connect, on respective opposite sides, the top and bottom branches.

Though efficient, folding units of the above type leave room for improvement.

In particular, as the hingedly joined chain links are rigid, the chain substantially forms a polygon about the driving sprocket and the idler wheel. As a consequence, the radius of the chain varies periodically around the driving sprocket and the idler wheel; as the driving sprocket and the idler wheel rotate at a constant angular speed, the varying radius causes the linear speed of the chain to fluctuate and the chain links to rise and fall with respect to their line of engagement with the driving sprocket and the idler wheel. This latter movement of the chain links does not actually occur as it is compensated by the tightener. The above-described phenomenon is known as "polygon effect" and is more evident in chains having big pitches and meshing with sprockets having reduced numbers of teeth.

The continuous intervention of the tightener to maintain the chain at a constant tension produces a periodic vibrating motion, which may affect the packs being conveyed and the quality of the forming operations performed on the packs as they advance.

DISCLOSURE OF INVENTION

It is an object of the present invention to provide a folding unit for producing folded packages of pourable food products from relative sealed packs, designed to provide a straightforward, low-cost solution to the aforementioned drawback, typically associated with the known folding unit.

According to the present invention, there is provided a folding unit for producing folded packages of pourable food products from relative sealed packs, as claimed in claim 1.

BRIEF DESCRIPTION OF THE DRAWINGS

A preferred, non-limiting embodiment of the present invention will be described by way of example with reference to the accompanying drawings, in which:

FIG. 17 shows a larger-scale perspective view of a pack the folding unit of the previous Figures is fed with.

BEST MODE FOR CARRYING OUT THE INVENTION

Figure 1:
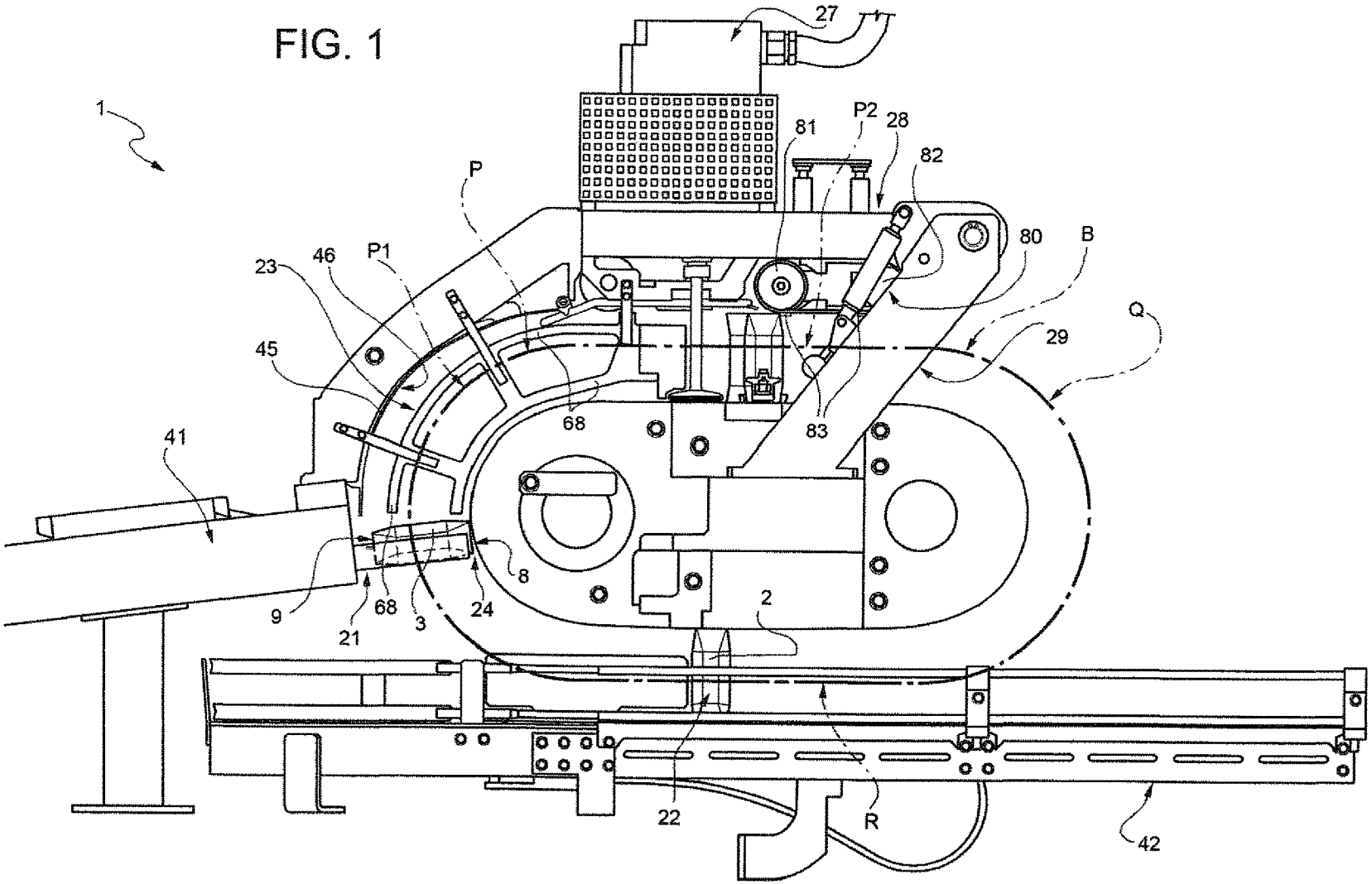
FIG. 1 shows a side view, with parts removed for clarity, of a folding unit in accordance with the present invention for producing packages of pourable food products from sealed pillow packs.

Number 1 in FIG. 1 indicates as a whole a folding unit for a packaging machine (not shown) for continuously producing sealed packages 2 of a pourable food product, such as pasteurized or UHT milk, fruit juice, wine, etc., from a known tube of packaging material (not shown).

The tube is formed in known manner upstream from unit 1 by longitudinally folding and sealing a known web (not shown) of heat-seal sheet material, which may comprise a base layer for stiffness and strength, which may be formed by a layer of fibrous material, e.g. paper, or of mineral-filled polypropylene material, and a number of layers of heat-seal plastic material, e.g. polyethylene film, covering both sides of the base layer. In the case of an aseptic package 2 for long-storage products, such as UHT milk, the packaging material may also comprise a layer of gas- and light-barrier material, e.g. an aluminium foil or an ethyl vinyl alcohol (EVOH) foil, which is superimposed on a layer of heat-seal plastic material, and is in turn covered with another layer of heat-seal plastic material forming the inner face of the package 2 eventually contacting the food product.

The tube of packaging material is then filled with the food product for packaging, and is sealed and cut along equally spaced cross sections to form a number of pillow packs 3 (FIG. 17), which are then transferred to unit 1 where they are folded mechanically to form respective packages 2.

Alternatively, the packaging material may be cut into blanks, which are formed into packages 2 on forming spindles, and packages 2 are filled with the food product and sealed. One example of this type of packages is the so-called "gable-top" package known by the trade name Tetra Rex (registered trademark).

In detail, pillow packs 3 are transferred to unit 1 by using an in-feed conveyor 41 (FIG. 1), which is described in more detail in the European application "Feeding unit and method for feeding sealed pillow packs of pourable food products to a folding unit", filed by the Applicant concurrently with the present invention.

Unit 1 also feeds folded package 2 to out-feed conveyor 42, shown in FIG. 1.

Figure 17:
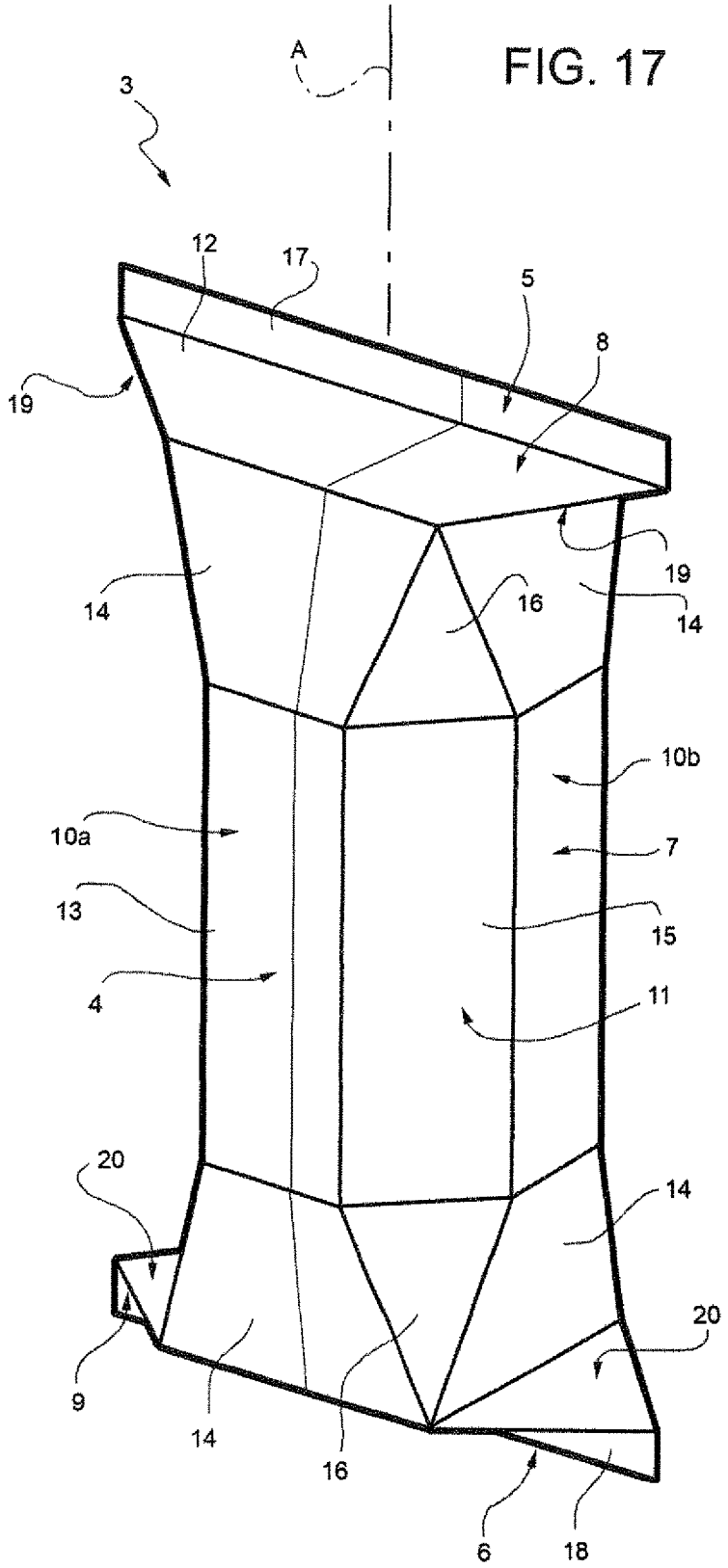

With reference to FIG. 17, an embodiment of a package 2 is shown which has a longitudinal sealing band 4, formed to produce the tube of packaging material from the web folded into a cylinder, extends along one side of each pack 3, which is closed at the opposite ends by respective transverse sealing bands 5, 6 perpendicular to and joined to longitudinal sealing band 4.

Each pack 3 has an axis A, and comprises a main body 7 and opposite, respectively top and bottom, end portions 8, 9 tapering from main body 7 towards respective transverse sealing bands 5, 6.

Main body 7 of each pack 3 is bounded laterally by four lateral walls 10*a*, 10*b* and four corner walls 11 alternate to each other, in the embodiment shown in FIG. 17.

Walls 10*a* (10*b*) are opposite to each other. In the very same way, walls 11 are opposite, in pairs, to each other.

Each wall 10*a*, 10*b* comprises a central rectangular stretch 13 and a pair of opposite, respective top and bottom, end stretches 14 which are interposed between stretch 13 and end portions 8, 9 of pack 3.

In detail, stretches 13 are substantially parallel to axis A. Each end stretch 14 is substantially in the form of an isosceles trapezium, which slopes slightly relative to axis A, and has a major edge defined by respective end portions 8, 9.

Each wall 11 comprises a central rectangular stretch 15 and a pair opposite, respective top and bottom, end stretches 16 which are interposed between stretch 15 and end portions 8, 9 of pack 3.

In detail, stretches 15 are substantially parallel to axis A. Each end stretch 16 is substantially in the form of an isosceles triangle, which slopes slightly relative to axis A and converges from relative stretch 15 towards corresponding end portions 8, 9.

Each end portion 8, 9 is defined by two walls 12, each substantially in the form of an isosceles trapezium, which slope slightly towards each other with respect to a plane perpendicular to axis A, and have minor edges defined by respective end edges of portions 14 of respective wall 10*a*, and major edges joined to each other by respective sealing bands 5, 6.

Longitudinal sealing band 4 extends between transverse sealing bands 5 and 6, and along the whole of one wall 10*a* and the corresponding walls 12 on the same side as wall 10*a*.

Each pack 3 also comprises, for each end portion 8, 9, a respective substantially elongated rectangular end fin 17, 18 projecting in the direction of axis A from relative pack 3; and two substantially triangular flaps 19, 20 projecting laterally on opposite sides of main body 7 and defined by end portions of relative walls 12.

More precisely, each end fin 17, 18 extends along a direction orthogonal to axis A.

To form a package 2, unit 1 presses end portions 8, 9 of relative pack 3 down flat towards each other, and at the same time folds respective fins 17, 18 onto end portions 8, 9.

Furthermore, unit 1 folds flaps 20 onto top stretches 14 of respective walls 10*b* and folds flaps onto previously folded fin 17, on the opposite side of end portion 9.

Figure 2:
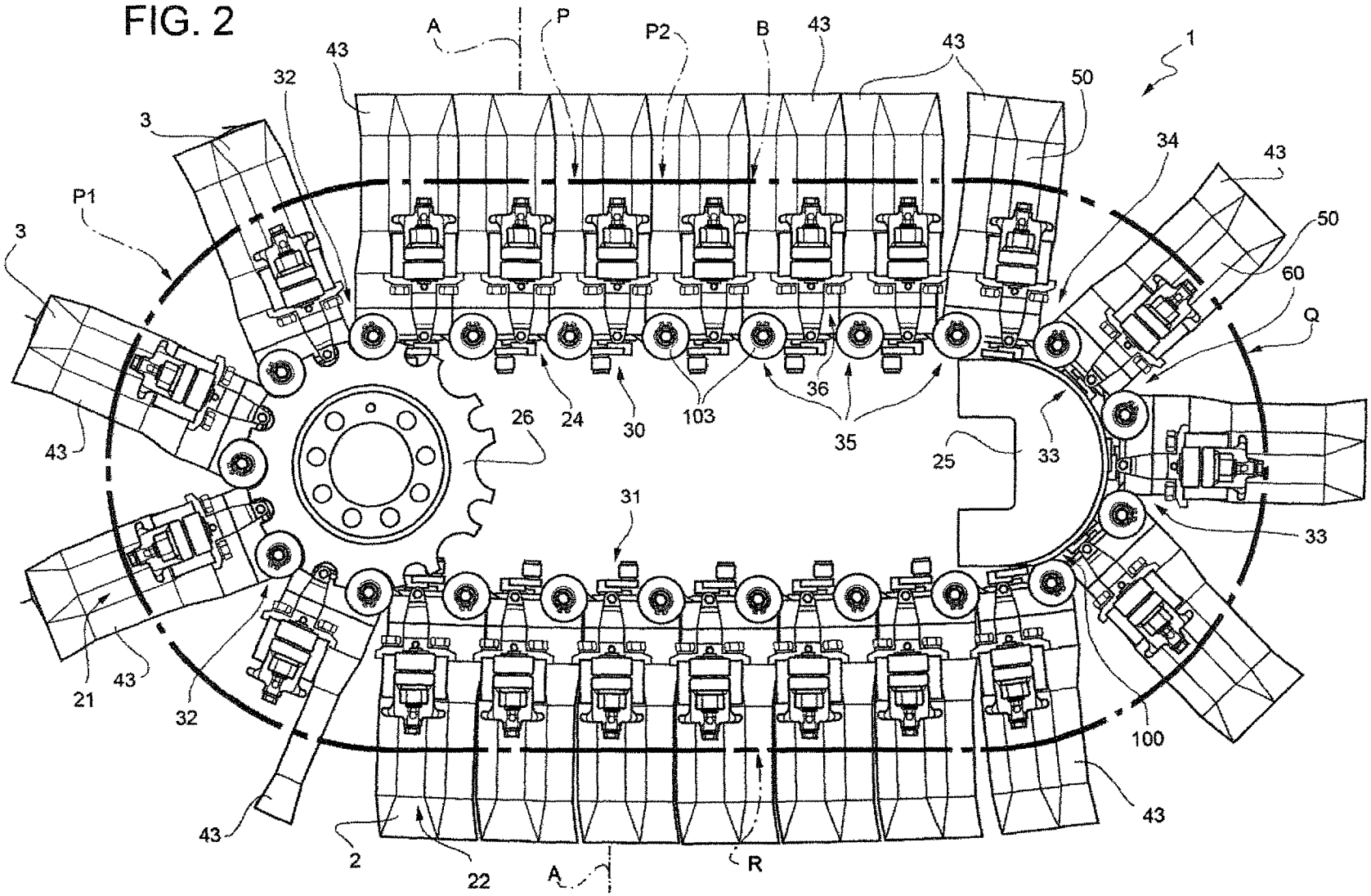
FIG. 2 is a larger-scale side view of the folding unit of FIG. 1, with parts removed for clarity.

With reference to FIGS. 1 and 2, unit 1 substantially comprises:

a frame 29;

an endless conveyor 34 for feeding packs 3 continuously along a forming path B from a supply station 21 to an output station 22 (both shown only schematically);

folding means 23 which cooperate cyclically with each pack 3 to flatten end portion 8, fold relative fin 17 onto end portion 8, and fold flaps 19 onto previously flattened end portion 8 on the opposite side of end portion 9;

folding means 24 for flattening end portion 9, folding relative fin 18 onto end portion 9 and bending flaps 20 towards axis A and end portion 9;

a heating device 27 acting on bent flaps 19, 20 to melt the external layer of the packaging material and seal the flaps 19, 20 before they are pressed against end portion 8 and relative walls 10*b* respectively; and a pressing device 28 cooperating with each pack 3 to hold flaps 19 onto flattened fin 17 as flaps 19 cool.

Heating device 27 is, in particular, arranged between folding means 23 and pressing device 28 along forming path B.

With particular reference to FIGS. 2, 4, 5, 7 and 8, conveyor 34 basically comprises an endless transport element, in the example shown a chain 60, formed by a plurality of mutually hinged rigid modules or links 35 and looped about a pair of coaxial driving sprockets 26 and an idler element 25.

Chain 60 comprises a straight horizontal top branch 30, a bottom branch 31 substantially parallel to branch 30, and two curved C-shaped portions 32, 33, which are positioned with their concavities facing each other and connect branches 30 and 31; more specifically, C-shaped portion 32 cooperates with driving sprockets 26, whilst C-shaped portion 33 cooperates with idler element 25.

Each link 35 comprises a substantially flat plate 36 adapted to receive a relative pack 3, and a paddle 43, which projects perpendicularly from plate 36 on the opposite side of driving sprockets 26 and idler element 25 and which cooperates with and pushes a corresponding wall 10 of a relative pack 3 to feed it along path B.

Figure 3:
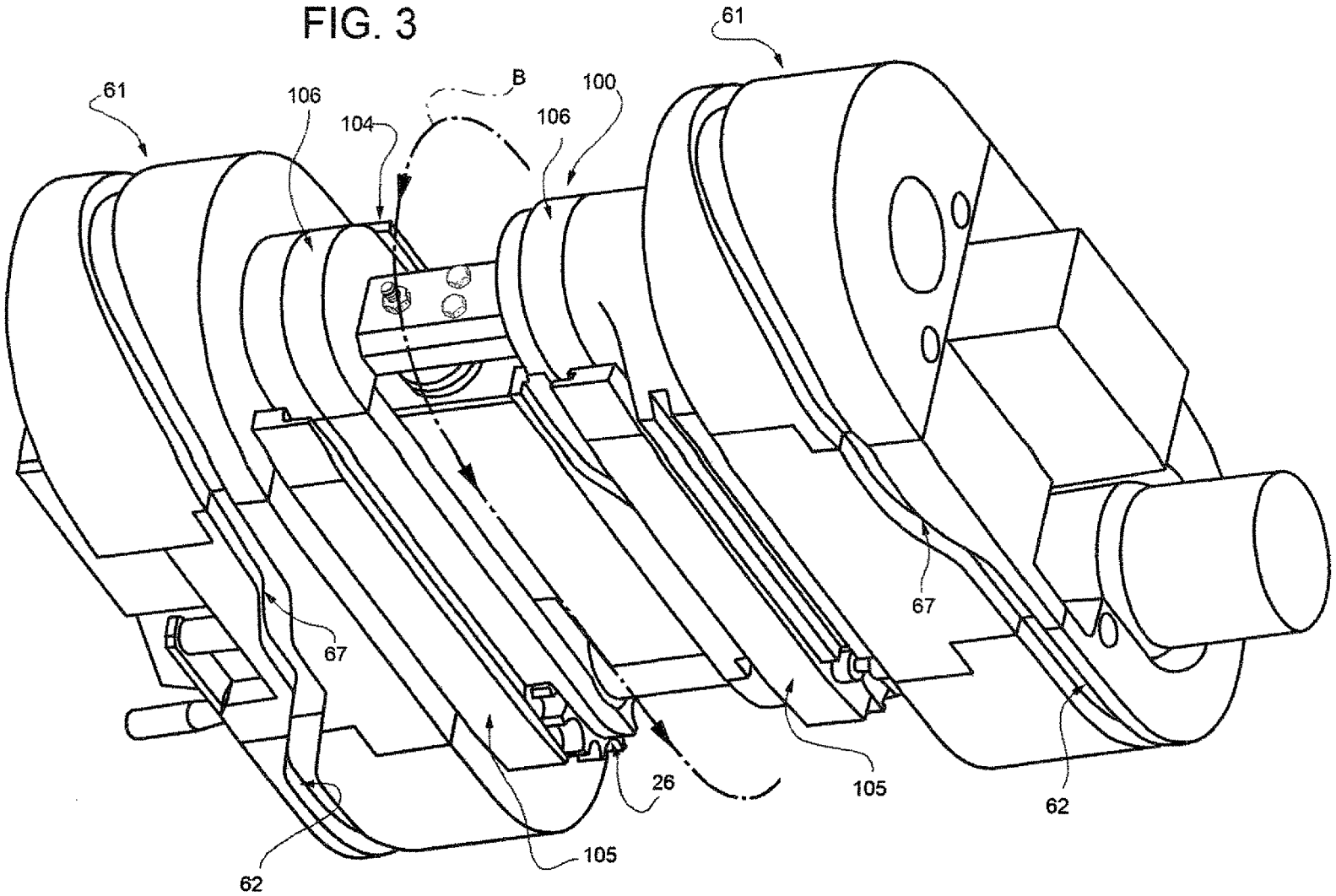
FIGS. 3 and 4 show respectively bottom and top perspective views, with parts removed for clarity, of the folding unit of FIG. 2.

Advantageously, idler element 25 comprises cam means 100 (FIGS. 3, 5 and 6) cooperating with respective cam followers 101 of the links 35 and so shaped as to compensate the periodical variation of the radius of the links 35 on the driving sprockets 26 due to the rigidity of the links 35.

Figure 5:
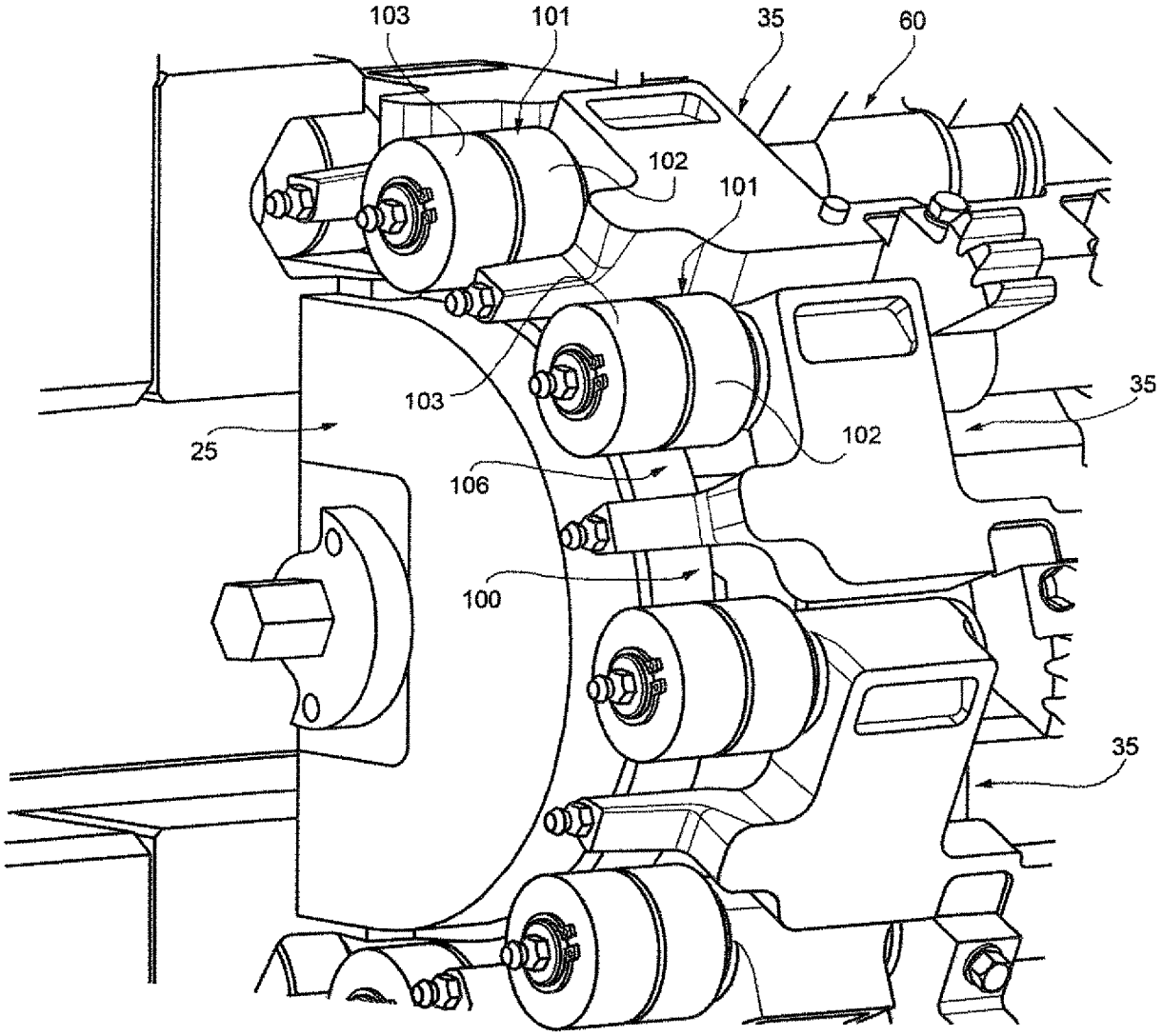
FIG. 5 shows a larger-scale view in perspective of a detail of the folding unit of FIG. 2.
Figure 8:
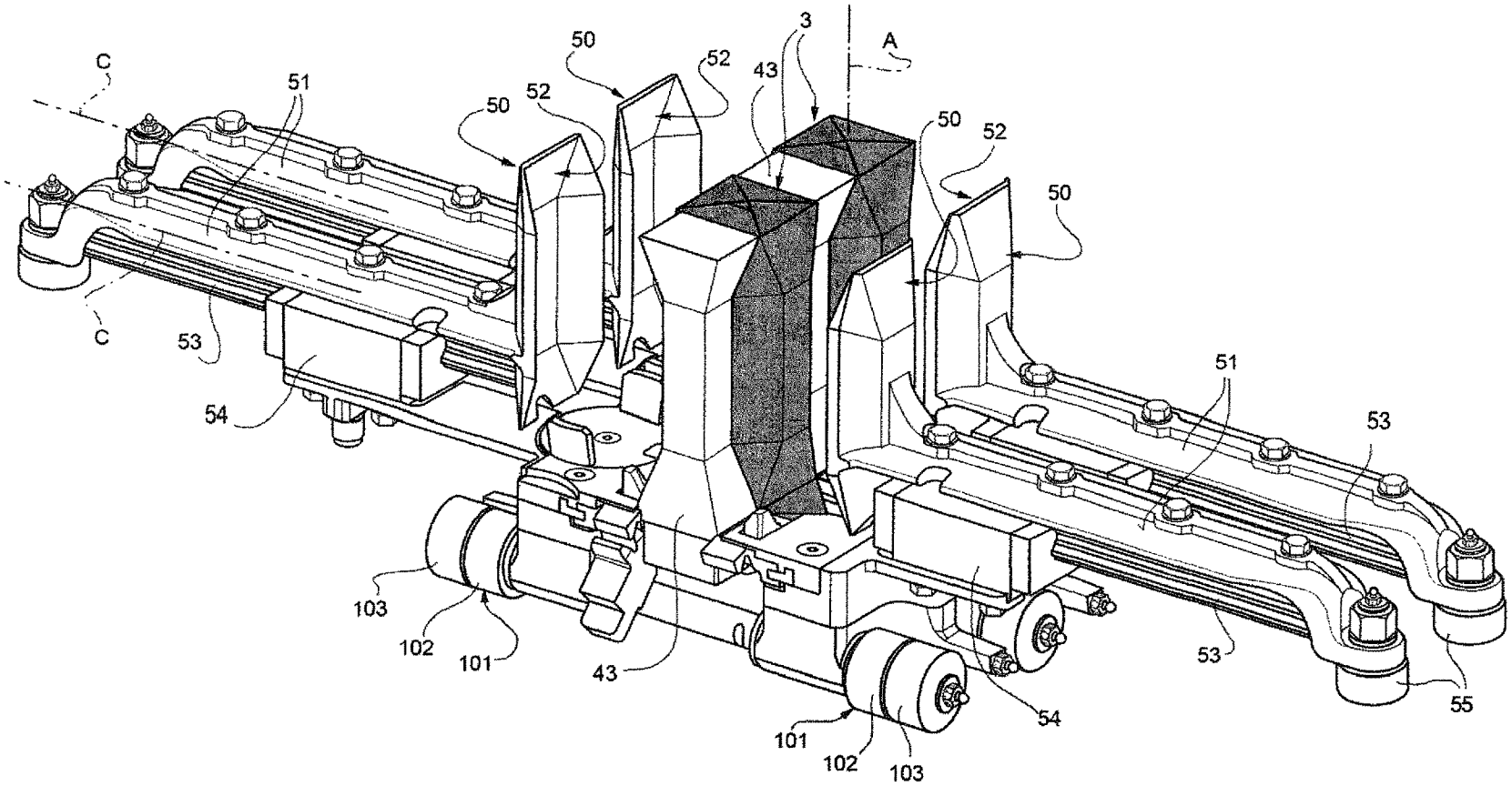
FIGS. 8 to 12 show some components of the folding unit of FIGS. 1 to 4 in different operative conditions.
Figure 9:
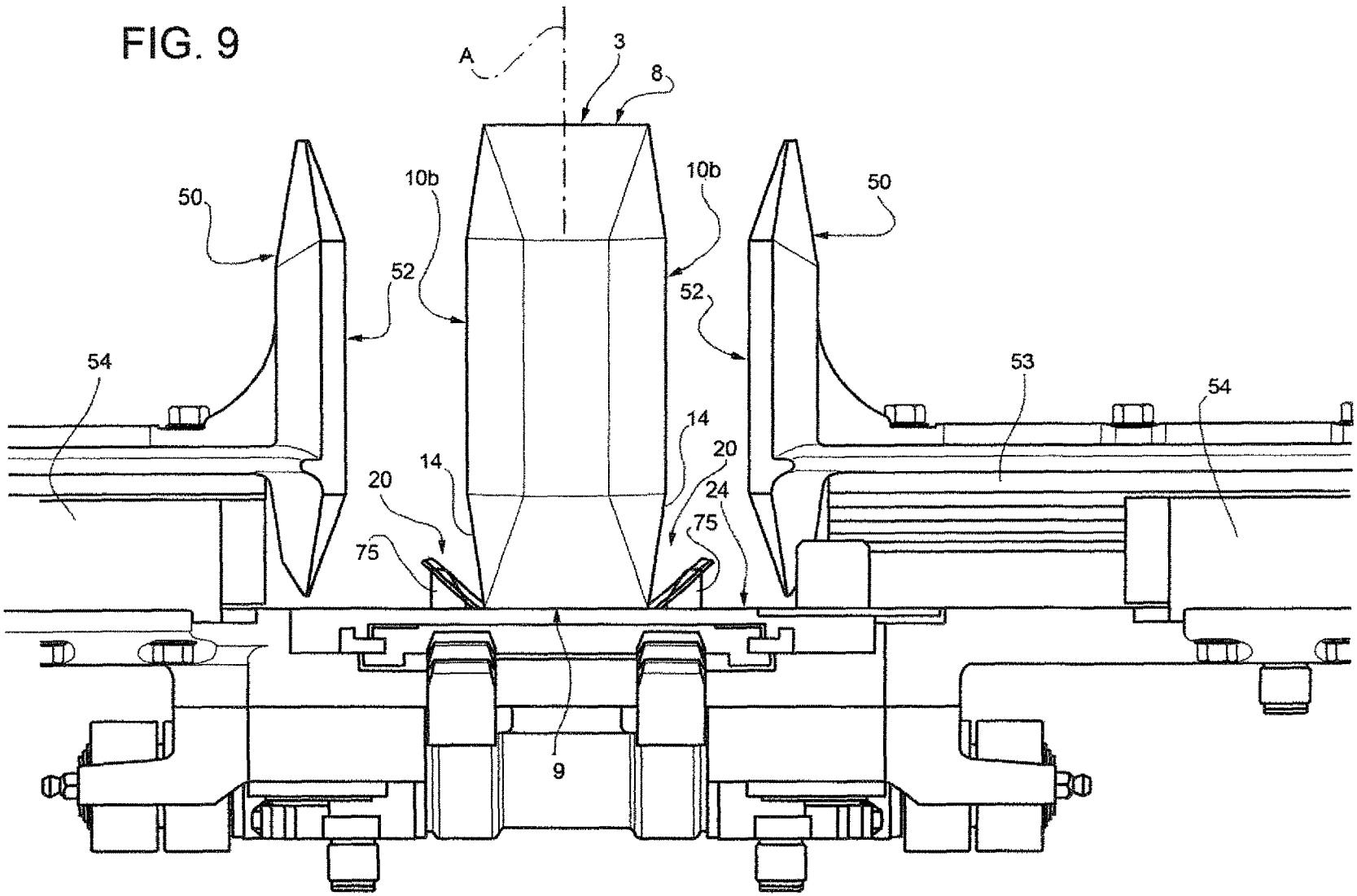

In particular, with reference to FIGS. 5 and 8, each link 35 is provided, on opposite sides, with respective pairs of rollers 102, 103; the inner rollers 102 define cam followers 101 adapted to cooperate with cam means 100 of idler element 25, whilst the outer rollers 103 cooperate in use with respective straight top and bottom guide elements 104, 105 arranged at the opposite sides of top and bottom branches 30, 31 of chain 60, respectively.

In the example shown, cam means 100 comprise a pair of raised cam surfaces 106, which are provided on idler element 25 at the opposite sides of chain 60 and on which respective rollers 102 of each link 35 slide in use.

Figure 6:
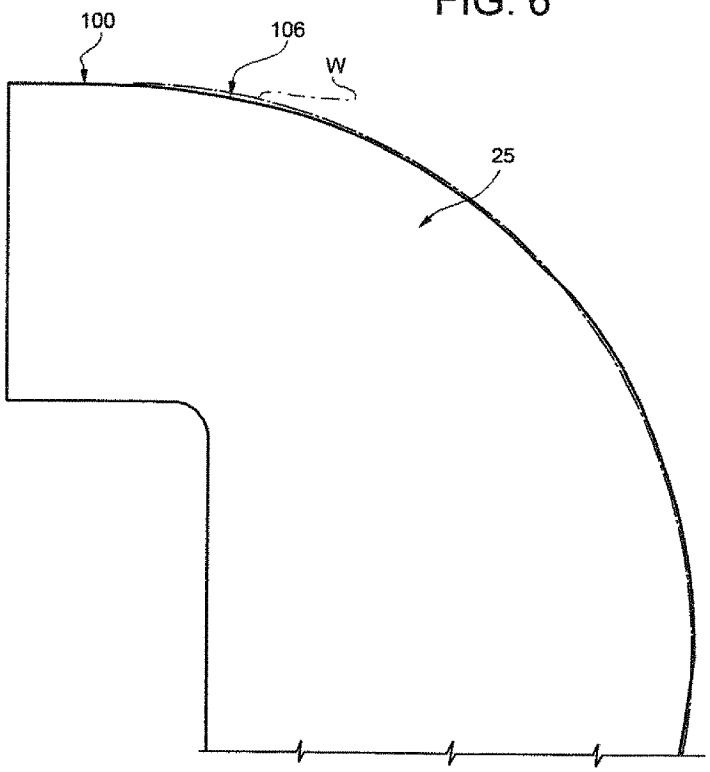
FIG. 6 shows a larger-scale side view of part of a cam element of the folding unit of FIGS. 2 and 5.

As shown in FIG. 6, each cam surface 106 has a relative profile departing from the circular one, represented with dot-dash line W.

In particular, the profile of each cam surface 106 is obtained by a computation method as a function of the motion profile determined by:

imposing, to the rollers 102 of some of the links 35 cooperating with the cam surface 106, predetermined movements to obtain a kinematically defined system, i.e. defining a single kinematic result; and connecting the selected links 35 with the remaining part of the chain 60 through other links 35 which also cooperate with the cam surface 106 and can freely move to maintain constant the length of the chain 60.

More specifically, the above-mentioned motion profile for determining the profile of each cam surface 106 is obtained by:

choosing six links 35;

imposing the relative roller 102 of one of the chosen links 35 to only rotate about its axis so that the distance between its axis and the axis of the hypothetical circular cam profile W is maintained constant;

imposing to the relative roller 102 of another one of the chosen links 35 to only translate along a radial direction with respect to the axis of the hypothetical circular cam profile W; and allowing the relative rollers 102 of the other links 35 to freely move in order to maintain constant the length of the chain 60.

Figure 7:
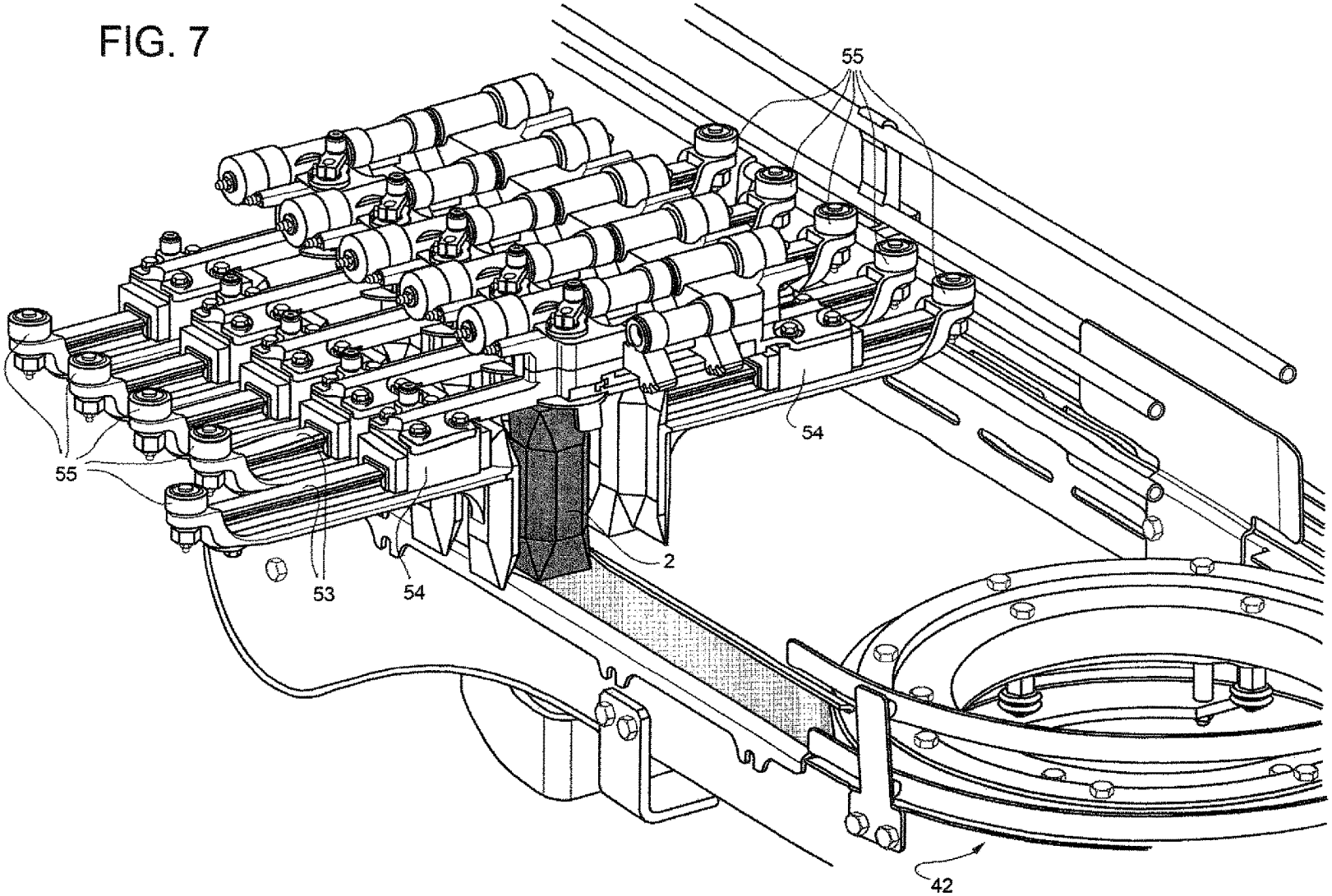
FIG. 7 shows a top perspective view, with parts removed for clarity, of the folding unit of FIGS. 1 to 4.

With reference to FIGS. 4 and 7 to 16, unit 1 further comprises a plurality of pairs of shells 50 which are integrally movable along path B and are movable along a direction C transversal to path B; shells 50 of each pair may be arranged in:

a fully closed position in which they exert a pressure onto a relative pack 3, so as to complete a folding operation thereon; and an open position in which they are detached from folded package 2 (FIGS. 7 and 8).

Furthermore, shells 50 may be arranged also in a closed position, in which they grip folded package 2 but substantially do not exert any pressure thereon.

In detail, station 21 is defined by C-shaped portion 32 and station 22 is defined by bottom branch 31 in a position closer to C-shaped portion 32 than to C-shaped portion 33.

Path B comprises, proceeding from station 21 to station 22:

a portion P starting from station 21, comprising a curved stretch P1 and a straight stretch P2, and along which packs 3 are folded into relative packages 2;

a curved portion Q along which folded packages 2 are overturned of 180 degrees; and a straight portion R arranged downstream from curved portion Q and upstream from station 22.

In detail, stretch P1 is defined by a part of C-shaped portion 32 and stretch P2 is defined by top branch 30 of chain 60. Portion Q is defined by C-shaped portion 33, and portion R is defined by part of bottom branch 31 of chain 60.

Folding means 23 cooperate cyclically with each pack 3 along portion P.

Folding means 24 are defined by links 35 and, therefore, move together with chain 60 along path B.

Figure 10:
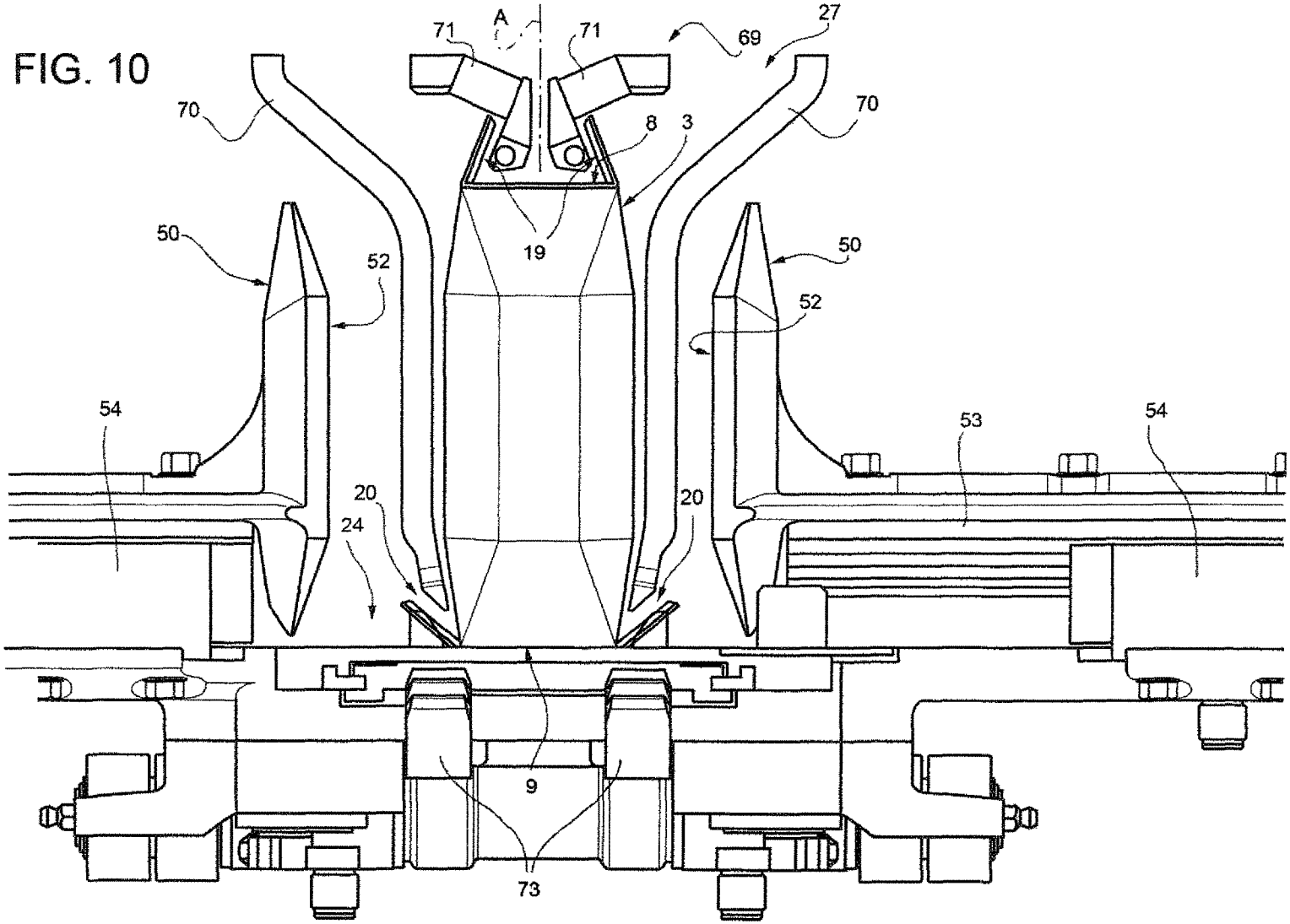

In detail, folding means 24 flatten end portion 9, folds relative fin 18 onto portion 9 and bend flaps 20 towards axis A and end portion 8, as relative pack 3 is carried along stretch P1 of path P (FIG. 10).

Figure 11:
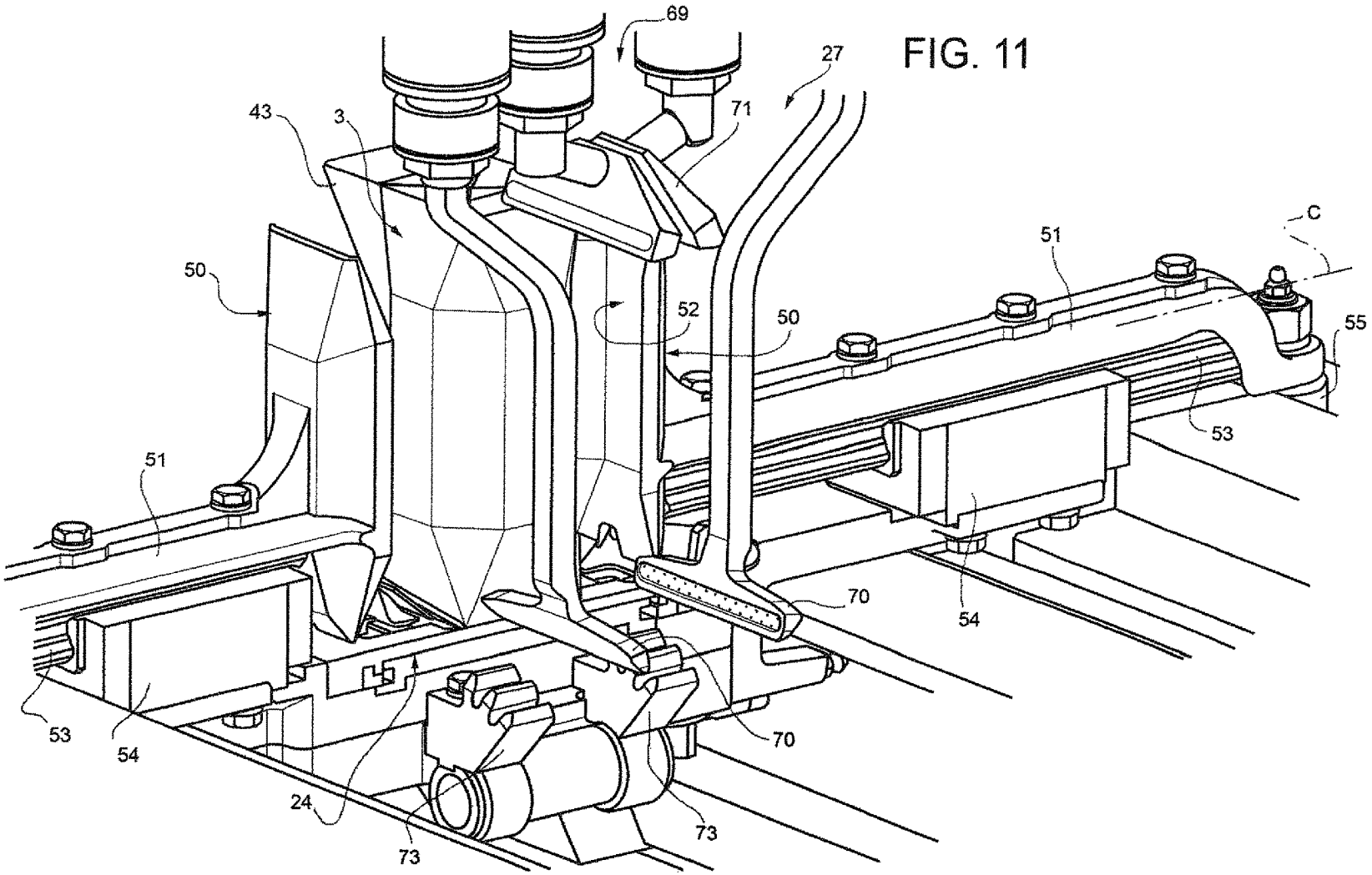
Figure 12:
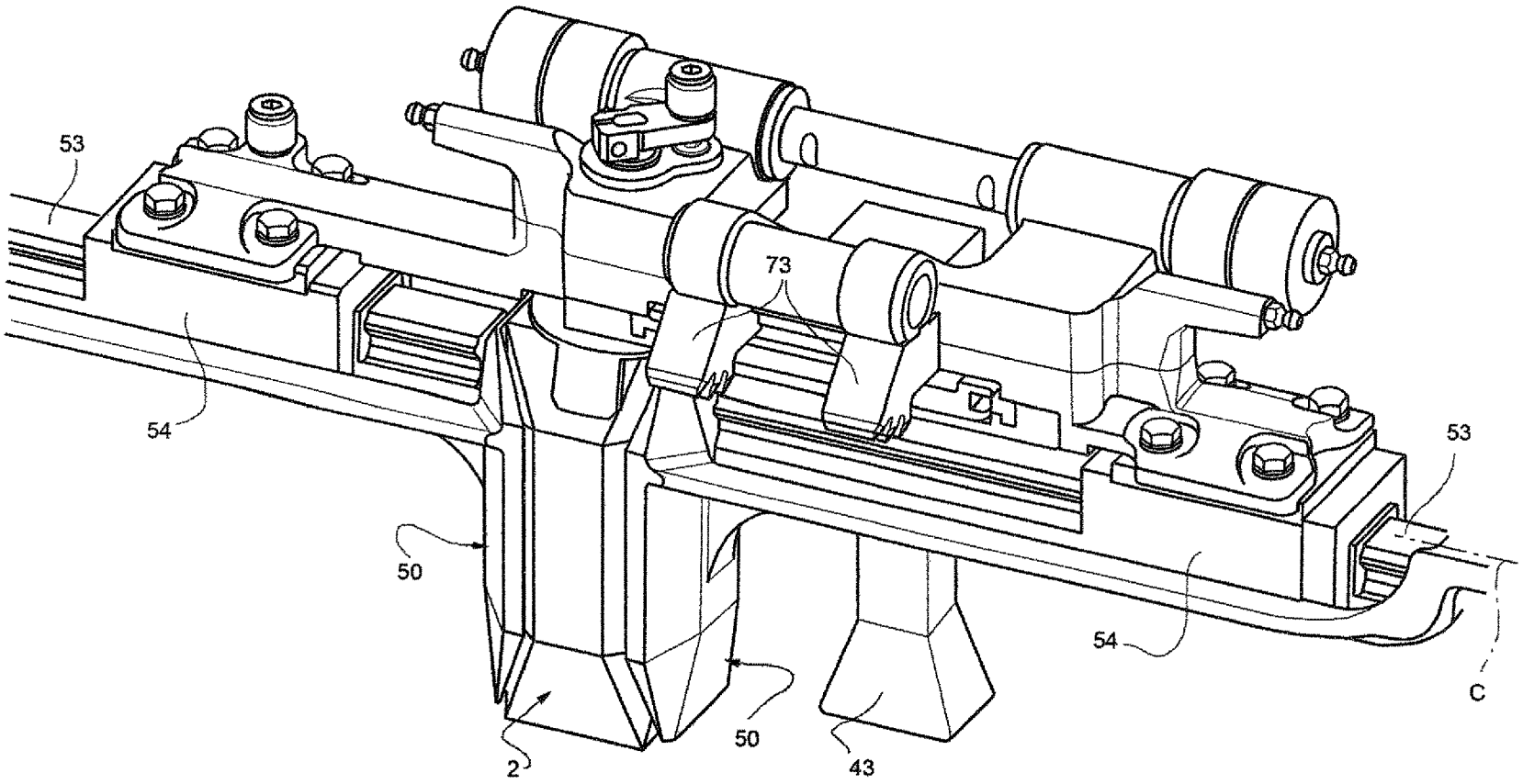

Heating device 27 acts on bent flaps 19, 20 to melt and seal the flaps 19, 20 before they are pressed against end portion 8 and relative walls 10*b* respectively, along stretch P2 of portion P (FIG. 11).

In detail, shells 50 of each pair cyclically move according to the following work cycle.

Shells 50 of each pair are arranged in the open position at station 21, move from open to fully closed position along stretch P1 and an initial part of stretch P2, and reach the fully closed position along a remaining part of stretch P2. In the embodiment shown, shells 50 reach the fully closed position downstream from heating device 27 and upstream from pressing device 28, proceeding according to the advancing direction of chain 60.

When shells 50 are arranged into the fully closed position they exert a certain pressure on relative walls 10*b* and 11 adjacent thereto.

More precisely, as moving between the open and the fully closed position along stretch P2 of portion P, shells 50 of each link 35 perform two functions:

- firstly, they complete the bending of flaps 20 onto top stretches 14 of relative walls 10*b*; and
- then, they press flaps 20, which have been previously bent and heated, onto stretches 14 of relative walls 10*b*.

Furthermore, shells 50 of each pair move from the fully closed position into the closed position at the beginning of portion Q.

Along portion Q, shells 50 integrally move parallel to direction C and relative to respective paddle 43 (FIG. 8).

In the embodiment shown, shells 50 move away relative to each other for a distance, for example of 2-4 mm, when they move from the fully closed position to the closed position.

In the following of the present description, only one link 35 will be described in detail, being clear that all links 35 are identical to each other.

Link 35 comprises (FIGS. 14 to 16):

- plate 36;
- paddle 43;
- rollers 102, 103;
- a pair of shells 50 which may move relative to paddle 43 along direction C;
- a pair of arms 51 connected to relative shells 50, elongated parallel to direction C and comprising each a relative slide 53;
- a pair of guides 54 which extend on opposite sides of relative paddle 43 along direction C, and relative to which slides 53 move parallel to direction C.

Referring again to FIGS. 1 and 2, plate 36 is arranged below, and then supports, pack 3 (or package 2) along portion P and a starting stretch of portion Q of forming path B.

Conversely, plate 36 is arranged above package 2 along portion R of forming path B. Accordingly, folded package 2 is released, under the gravity action at station 22, to conveyor 42.

Shells 50 define, on their sides opposite to arm 51, relative surfaces 52 which are adapted to cooperate with pack 3 and which face each other.

Surfaces 52 mirror the lateral surface of packages 2 to be folded, so as to control the final shape of packages 2.

In the embodiment shown, each surface 52 mirrors a relative walls 10*b* and parts of relative walls 11.

Each arm 51 comprises, on its end opposite to relative shell 50, a roller 55.

Each slide 53 is arranged between relative shells 50 and rollers 55 of relative arm 51. Furthermore, each slide 53 may slide parallel to direction C relative to guide 54.

In the embodiment shown, each arm 51 is integral with relative shell 50.

Paddles 43 mirror the shape of walls 10 and of the part of relative walls 11 they cooperate with.

Plate 36 of link 35 comprises (FIGS. 14 and 15):

- a rectangular portion 37 from which paddle 43 protrudes; and
- a contoured portion 38 which surrounds portion 37.

Plate 36 of link 35 also defines:

- a pair of through slots 39 which are arranged on opposite lateral sides of paddle 43 and elongated along a direction D tangent to forming path B and orthogonal to direction C;
- a through slot 40 which is in communication with slots 39, is arranged downstream from slots 39 and portion 37 proceeding according to the advancing direction of chain 60, and which extends parallel to direction C.

Slots 39 are arranged on lateral sides of portion 37 and slots 39, 40 are defined between portions 37, 38.

Slots 39 extend, along direction D, between slot 40 and relative bridges 47 which integrally connect portions 36, 37.

Slot 40 extends parallel to direction C.

Folding means 24 comprises, for each link 35:

- plate 36 which is integrally movable with paddle 43 along forming path B; and
- a C-shaped movable plate 72 which may move along direction D relative to paddle 43 and plate 36 between a first position (FIG. 14) in which it engages slot 40, so as to fold end fin 18 housed therein and a second position (FIG. 15) in which it leaves free slot 40.

In particular, slot 40 remains open when plate 72 is in the second position.

Link 35 also comprises a pair of toothed sectors staggered along relative direction C and which protrude from link 35 downstream from plate 36, proceeding according to the advancing direction of chain 60.

Plate 72 integrally comprises two arms 90 arranged on lateral sides of paddle 43, and a central element 91 interposed between arms 90.

Each arm 90 comprises a wedge 75 arranged on the side of paddle 43 and a rack 76 (FIG. 13) arranged on the side of driving sprockets 26 and idler element 25.

Element 91 is housed within slot 40 when plate 72 is in the first position, and is arranged upstream from slot when plate 72 is in the second position.

In the embodiment shown, wedges 75 are triangular in cross section and converge towards a mid-direction of link 35.

Wedges 75 are arranged downstream from racks 76, proceeding according to an advancing direction of chain 60.

Figure 13:
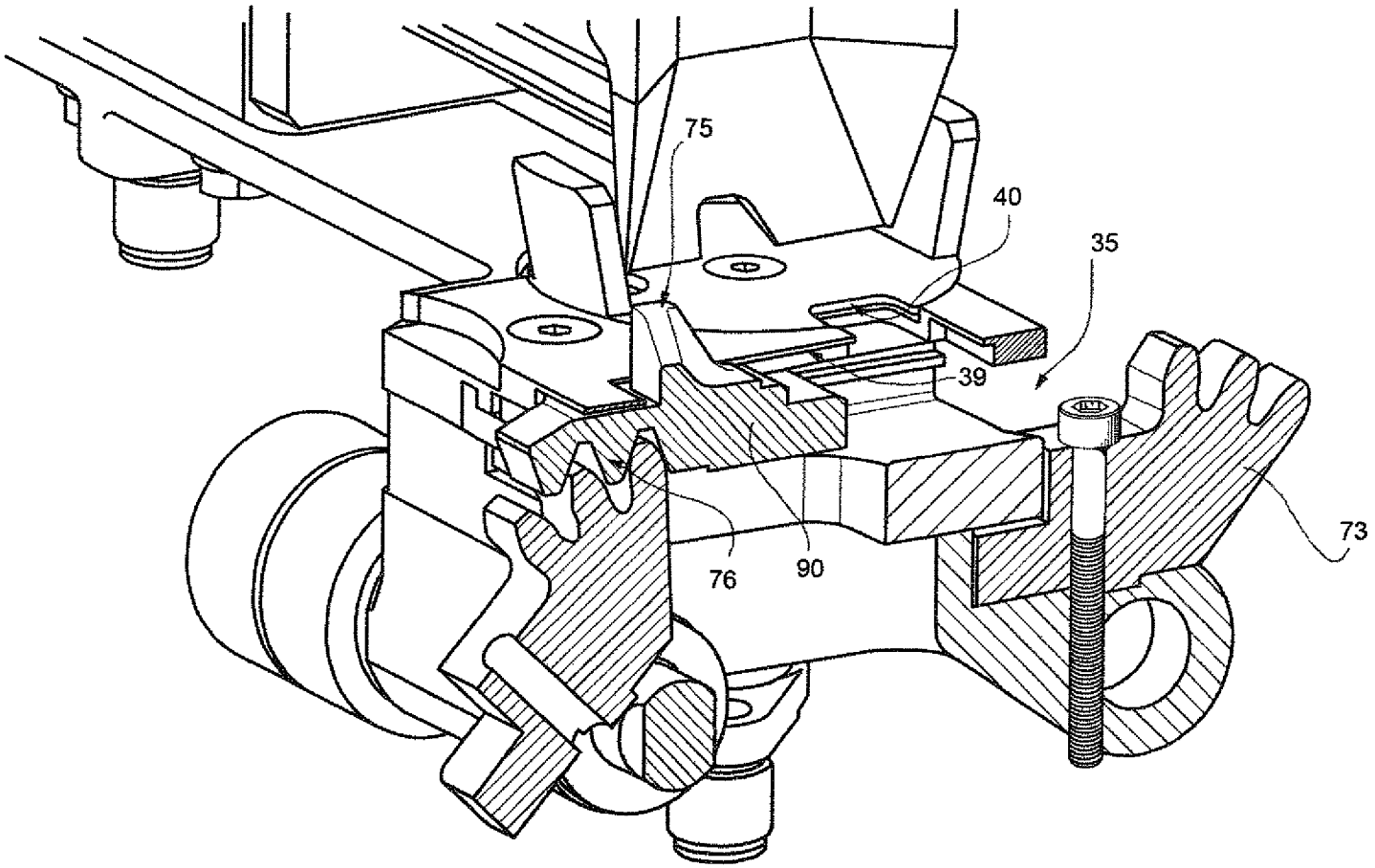
FIGS. 13 to 16 are perspective views of further components of the folding unit of FIGS. 1 to 4.
Figure 14:
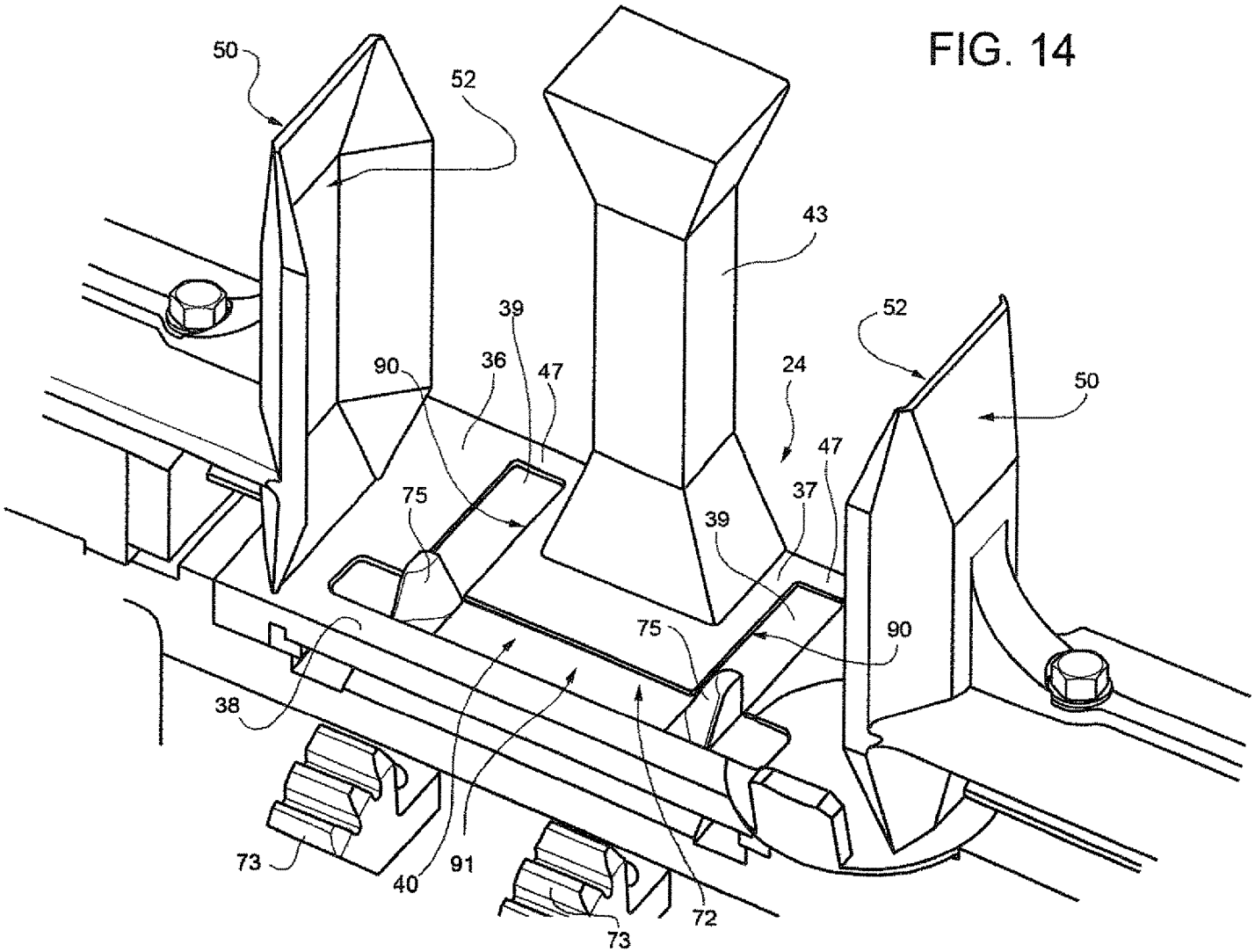
Figure 15:
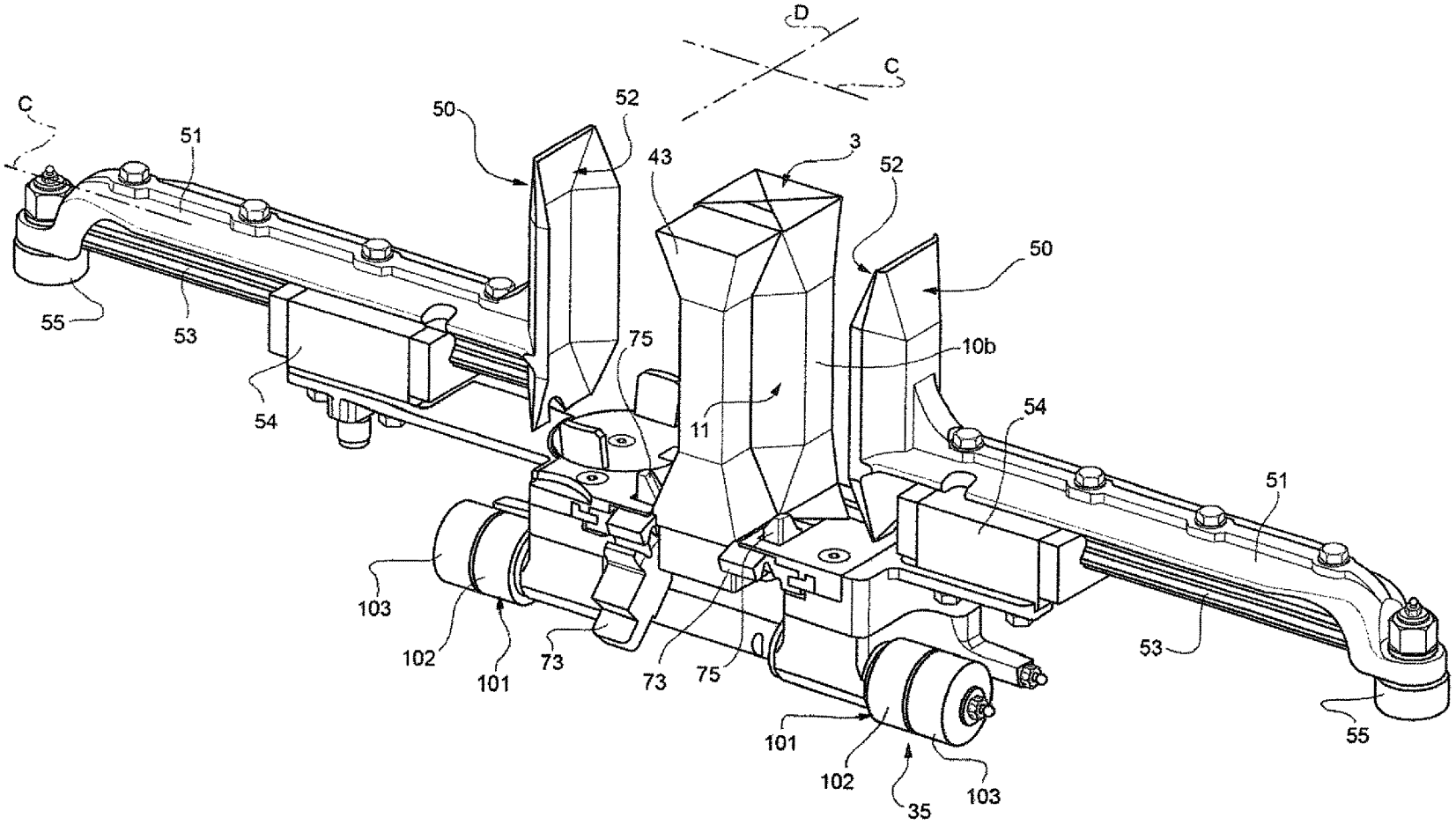
Figure 16:
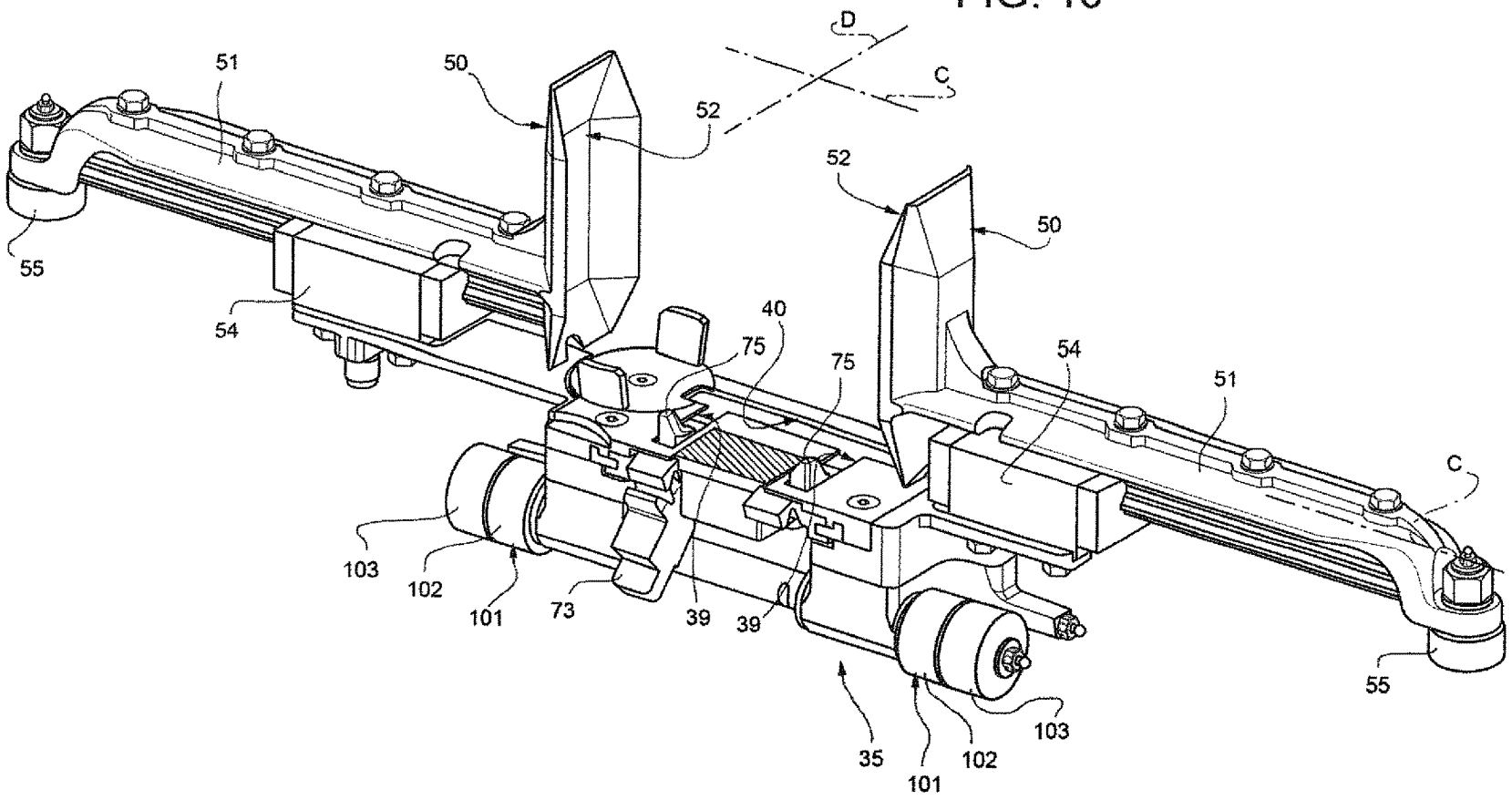

Toothed sectors 73 of each link 35 mesh with racks 76 of the following link 35 proceeding along the advancing direction of chain 60 (FIG. 13).

Plate 72 is arranged in the second position at station 21, moves from the second to the first position along stretch P1 of path B, remains in the first position along stretch P2 of path B, moves from the first to the second position along portion Q of path B, and remains in the second position along portion R of path B and from station 22 to station 21.

More precisely, fin 18 of pack 3 is arranged within open slot 40 of link 35 at station 21. When plate 72 of link 35 moves in the first position and engages slot 40, fin 18 is folded onto end portion 8. At the same time, wedges 75 raise flaps 20 towards end portion 8 and bend flaps 20 relative to axis A, up to when they reach the position shown in FIG. 10.

The corresponding shells 50, as moving from the open to the fully closed position, press flaps 20 against top stretches 14 of relative walls 12, downstream from folding means 23 and heating device 17, proceeding according to the advancing direction of chain 60.

Unit 1 also comprises a pair of cams 61 (FIGS. 3 and 4) adapted to control the movement of each pair of shells 50 between relative fully closed position, closed position and open position, as each pair of shells 50 advances along path B.

Furthermore, cams 61 also control the movement of each pair of shells 50 integrally to each other along direction C and relative to paddle 43 of corresponding link 35.

In detail, cams 61 are arranged on opposite lateral sides of chain 60.

One cam 61 comprises a groove 62 which is engaged by rollers 55 of first shells 50.

The other cam 61 comprises a further groove 62 which is engaged by rollers 55 of second shells 50.

Figure 4:
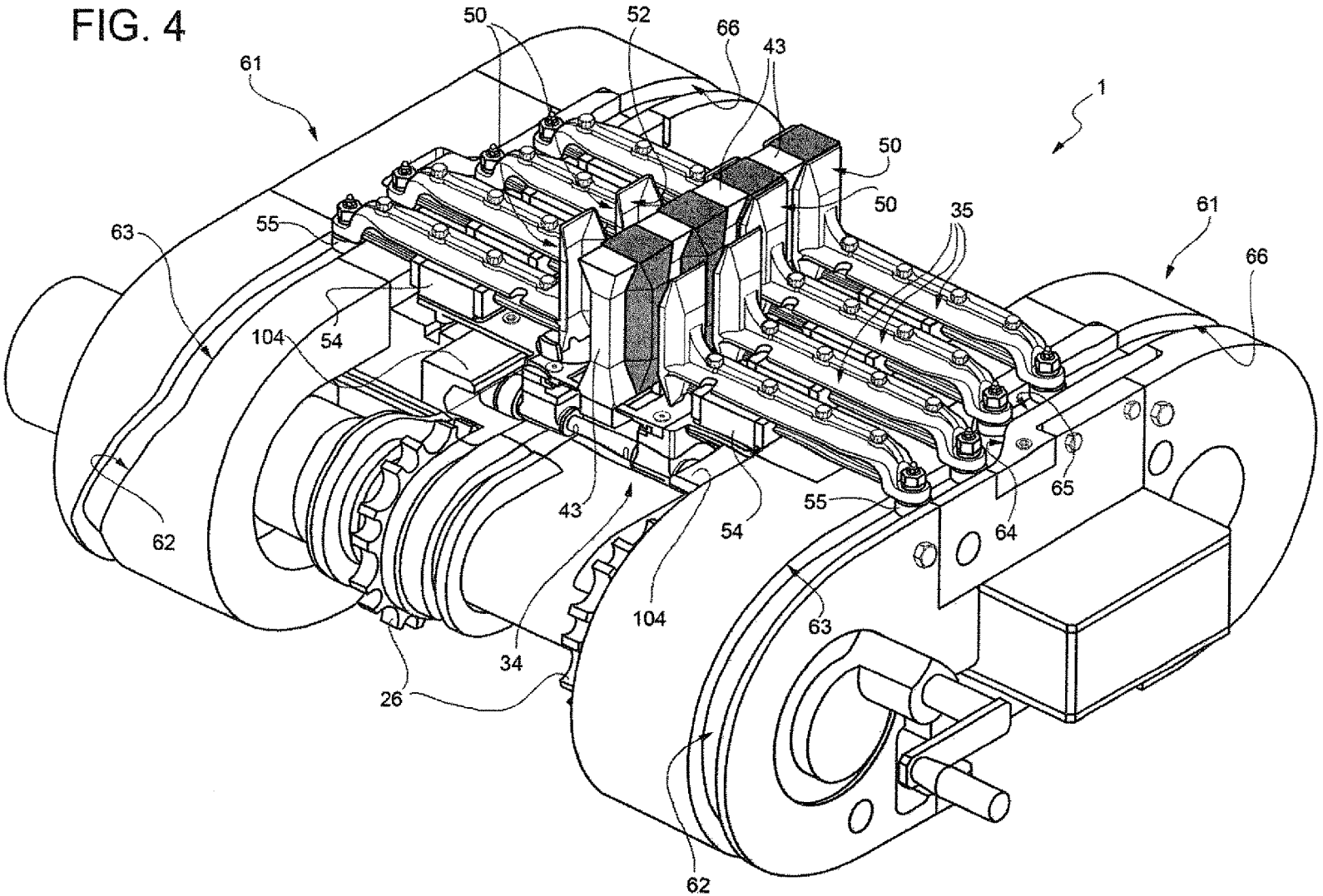

With reference to FIG. 4, grooves 62 comprise, proceeding from station 21 to station 22:

- relative straight portions 63 which are adapted to keep shells 50 of each pair in the open position;
- relative converging portions 64 which are adapted to move shells 50 from relative open to relative fully closed portion along stretch P2 of path P;
- relative straight portions 65 which are adapted to keep shells 50 of each pair in respective fully closed position;
- relative curved portions 66 which are adapted to integrally move shells 50 with respect to paddle 43 and parallel to respective directions C; relative curved portions 66 also move shells 50 from respective fully closed to respective closed positions; and
- relative curved portions 67 which are adapted to move shells 50 from respective closed to respective open positions.

Folding means 23 comprise a guide member 45 fitted in a fixed position between station 21 and heating device 27 (FIG. 1).

Guide member 45 defines a contrast surface 46 (FIG. 1) converging towards chain 60 and cooperating in a sliding manner with end portion 9 of each pack 3 to compress and flatten end portion 9 towards chain 60.

Frame 29 also comprises a pair of fixed sides 68 (only one shown in FIG. 1) for laterally containing packs 3 along path B, located on opposite sides of chain 60, and extending between station 21 and heating device 27.

Heating device 27 comprises (FIGS. 1, 9, 10 and 11):

- an assembly air device 69 fitted to frame 29;
- a pair of first nozzles 70 connected to assembly 69 and adapted to direct hot air onto flaps 20 of each pack 3 before each pack 3 reaches final pressing device 28; and
- a pair of second nozzles 71 connected to assembly 69 and adapted to direct hot air onto flaps 19 of each pack 3 before a relative pair of shells 50 reaches the fully closed position.

Pressing device 28 comprises (FIG. 1) a belt 80 wound onto a drive wheel 81 and a driven wheel 82. Belt 80 comprises, on its outer surface opposite to wheels 81, 82, a plurality of projections 83 which are adapted to press flaps 19 of each pack 3 onto relative fin 17.

The volume of each package 2 in formation is controlled, downstream from heating device 27, within a compartment bounded by:

- paddles 43 of relative link 35 and of the link 35 arranged immediately downstream proceeding according to the advancing direction of chain 60;
- shells 50 of relative link 35 which are arranged in the fully closed position; and
- plate 72 of relative link 35 arranged in the second position; and
- belt 80.

Operation of unit 1 will be described with reference to one pack 3 and to relative link 35 as of an initial instant, in which pack 3 is fed from the in-feed conveyor to chain 60 at station 21 of path B.

In this condition, link 35 is moving at the beginning of stretch P1 and therefore slot 40 is open. Furthermore, shells 50 are arranged into the open position.

In detail, pack 3 is positioned with end fin 18 facing plate 72 of link 35, and slides on one wall 10*a* along relative paddle 43, so that fin 18 is parallel to paddle 43, until when fin 18 enters open slot 40.

In this condition, pack 3 is arranged above and, therefore, supported by plate 36 of link 35.

As link 35 moves along stretch P1 and a portion of stretch P2, contrast surface 46 cooperates in a sliding manner with end portion 8 of pack 3. In this way, portions 8 and 9 are flattened towards each other, fin 17 is folded onto portion 8 and flaps 20 are bent relative to portion 8 towards axis A and on the opposite side of portion 8, as shown in FIG. 11.

At the same time, each pair of consecutive links 35 moves towards each other along stretch P1. In this way, racks 76 of the subsequent link 35 are thrust by toothed sectors 73 of the precedent link 35, proceeding according to the advancing direction of chain 60 along stretch P1 of forming path B.

Accordingly, plate 72 of the subsequent link 35 moves from the second position to the first position, in which it engages slot 40.

As plate 72 engages slot 40, fin 18 is folded onto end portion 9. Simultaneously, wedges 75 raise flaps 20 towards end portion 8 and bend flaps 20 relative to axis A, as shown in FIGS. 10 and 11.

As link 35 moves along stretch P2, shells 50 move from the open position to the fully closed position and plates 72 are arranged in the second position.

Before shells 50 reach pack 3, nozzles 70, 71 direct air onto flaps 19, 20 of pack 3, to partly and locally melt the packaging material of flaps 19, 20 (FIG. 11).

Immediately after, shells 50 contact walls 10*b*, 11 of packs 3, and press flaps 20 onto relative top stretches 14 of walls 11 as flaps 20 cool. In this condition, shells 50 are arranged in the fully closed position.

Subsequently, pack 3 is arranged below belt 80 and projections 83 press flaps 20 onto portion 9, as flaps 20 cool.

In this condition, the volume of folded package 2 is controlled by two paddles 43 of respective consecutive links 35, by shells 50 arranged in the fully closed position, and by projections 83 of belt 80.

Folded package 2 then move along portion Q of path P.

Along portion Q, shells 50 move relative to each other from the fully closed to the closed position, in which they grip package 2 but substantially do not exert any pressure thereon.

Furthermore, shells 50 move together with package 2 relative to paddle 43 parallel to direction C, along portion Q.

In this way, shells 50 together with folded package 2 are staggered from paddle 43, at the end of portion Q.

Along portion Q, each pair of consecutive links 35 move away from each other. In this way, racks 76 of the subsequent link 35 move away from toothed sectors 73 of the precedent link 35.

Accordingly, plate 72 of the subsequent link 35 moves back from the second to the first position, in which it leaves free slot 40.

Finally, folded package 2 and shells 50 arranged in the closed position are conveyed along portion R.

It is important to mention that during the descending stretch of portion Q and along portion R of path B, folded package 2 is arranged below plate 36 and is supported by the shells 50 arranged in the closed position.

At station 22, shells 50 move back to the open position and package 2 is released, under the gravity action, to the out-feed conveyor.

Being staggered relative to shells 50 and package 2, paddle 43 does not interfere with the release of package 2.

Subsequently, shells 50 are conveyed by chain 60 towards station 21 and move from the closed to the open position.

The advantages of unit 1 according to the present invention will be clear from the foregoing description.

In particular, thanks to the presence of cam means 100 of idler element 25, the vibrations on chain 60 are greatly reduced with a consequent better forming of packages 2 on folding unit 1.

Moreover, the strong reduction of vibrations on chain 60 allows a reliable and highly precise releasing of the packages 2 at output station 22 along the bottom branch 21 of chain 60. This result could not be achieved with the normally vibrating chains according to the state of the art, as the vibrations may produce the undesired falling of the packages along the bottom branch of the chain.

Clearly, changes may be made to unit 1 and to the method without, however, departing from the protective scope defined in the accompanying Claims.

The invention claimed is:

1. A folding unit for producing folded packages of pourable food products from sealed packs, comprising:

conveying means fed with a plurality of said sealed packs at an input station and advancing said sealed packs along a forming path to an output station;

folding means for performing at least one folding operation on each of said sealed packs;

said conveying means comprising an endless transport element formed by a plurality of mutually hinged rigid modules and looped about at least one sprocket and at least one idler element;

said at least one idler element comprising a cam cooperating with respective cam followers of said plurality of mutually hinged rigid modules and so shaped to compensate the periodical variation of the radius of the plurality of mutually hinged rigid modules on the at least one sprocket due to rigidity of the plurality of mutually hinged rigid modules;

each module of said plurality of mutually hinged rigid modules comprising a supporting element for each of the sealed packs; and said endless transport element including:

a straight horizontal top branch along which said supporting element is arranged at a position below each of the sealed packs, and a straight horizontal bottom branch defining said output station and along which each of said folded packages is arranged at a position below said supporting element.

2. The unit as claimed in claim 1, wherein said cam comprises at least one cam surface having a non-circular shape.

3. The unit as claimed in claim 1, wherein said endless transport element is a chain and said plurality of mutually hinged rigid modules are mutually hinged links of said chain.

4. The unit as claimed in claim 1, wherein each of said plurality of mutually hinged rigid modules comprises one pair of shells which are integrally movable along said forming path with said mutually hinged rigid module, each of the one pair of shells being movable relative to each other along a direction transversal to said forming path;

said shells of each pair being settable along said direction at least in:

a closed position, in which they grip the relative said sealed pack; and an open position, in which they are detached from the corresponding said folded package.

5. A folding unit for producing folded packages of pourable food products from sealed packs, comprising:

a conveyor fed with a plurality of the sealed packs at an input station to advance the sealed packs along a forming path to an output station, the conveyor comprising a plurality of mutually hinged rigid modules;

each of the mutually hinged rigid modules comprising at least one cam roller;

at least one folding element configured to cooperate with each of the sealed packs to perform at least one folding operation on each of the sealed packs;

a sprocket about which the conveyor passes to drive rotation of the conveyor;

an idler element comprising an outer cam surface, the at least one cam roller of each of the mutually hinged rigid modules contacting and rolling along the outer cam surface when the sprocket drives rotation of the conveyor so that the conveyor passes around the idler element; and the outer cam surface of the idler element being non-circularly shaped to compensate for periodical variation of the radius of the plurality of mutually hinged rigid modules due to rigidity of the plurality of mutually hinged rigid modules as the conveyor passes around the idler element, wherein each of the mutually hinged rigid modules comprises one pair of shells which are integrally movable with the mutually hinged rigid module along the forming path, each of the pairs of shells being movable relative to one another in a transverse direction transverse to the forming path at least in:

a closed position, in which the shells grip each of the sealed packs; and an open position, in which the shells are detached from each of the folded packages.

6. The folding unit as claimed in claim 5, wherein the conveyor is a chain and the plurality of mutually hinged rigid modules are mutually hinged links of the chain.

7. A folding unit for producing folded packages of pourable food products from sealed packs, comprising:

a conveyor fed with a plurality of the sealed packs at an input station and advancing the sealed packs along a forming path to an output station in a forming path direction, the conveyor comprising a plurality of mutually hinged rigid modules;

each of the mutually hinged rigid modules possessing a lower surface, an upper surface, a first side surface, and a second side surface, the first side surface and the second side surface being between the lower surface and the upper surface, the first side surface and the second side surface extending in the forming path direction;

each of the mutually hinged rigid modules comprising a first cam roller and a second cam roller that move together with the rigid module, the first cam roller being positioned outside the first side surface in a direction transverse to the forming path direction, and the second cam roller being positioned outside of the second side surface in the direction transverse to the forming path;

at least one folding element configured to cooperate with each of said sealed packs to perform at least one folding operation on said sealed pack;

a sprocket about which the conveyor passes to drive rotation of the conveyor;

an idler element comprising an outer cam surface, the first cam rollers and the second cam rollers contacting and rolling along the outer cam surface when the sprocket drives rotation of the conveyor so that the conveyor passes around the idler element;

the outer cam surface of the idler element being shaped to compensate for periodical variation of the radius of the plurality of mutually hinged rigid modules due to rigidity of the plurality of mutually hinged rigid modules as the conveyor passes around the idler element; and the conveyor including:

a straight horizontal top branch along which each of the mutually hinged rigid modules is arranged at a position below each of the sealed packs, and a straight horizontal bottom branch along which each of the mutually hinged rigid modules is arranged at a position above each of the sealed packs.

8. The folding unit as claimed in claim 7, wherein said conveyor is a chain and said plurality of mutually hinged rigid modules are mutually hinged links of said chain.

9. The folding unit as claimed in claim 7, wherein each of the mutually hinged rigid modules comprise one pair of shells which are integrally movable with the mutually hinged rigid modules along the forming path and are movable relative to each other along a direction transverse to the forming path;

the shells of each pair being settable along the transverse direction at least in:

a closed position, in which the shells grip each of the sealed packs; and an open position, in which the shells are detached from each of the folded packages.

* * * * *